United States Patent [19]

Ejiri

[11] Patent Number: 4,955,324

[45] Date of Patent: Sep. 11, 1990

[54] PULSE COMBUSTION UNIT FOR LIQUID HEATING APPARATUS

[75] Inventor: Susumu Ejiri, Toyoake, Japan

[73] Assignee: Paloma Kogyo Kabushiki Kaisha, Aichi, Japan

[21] Appl. No.: 463,330

[22] Filed: Jan. 10, 1990

[30] Foreign Application Priority Data

Jan. 11, 1989 [JP] Japan ..... 1-4298

[51] Int. Cl.[5] ..... F22B 37/24

[52] U.S. Cl. ..... 122/510; 122/24; 431/1

[58] Field of Search ..... 122/24, 510; 431/1

[56] References Cited

U.S. PATENT DOCUMENTS 3,938,476 2/1976 Kaupp ..... 122/510

4,259,928 4/1981 Huber ..... 122/24

FOREIGN PATENT DOCUMENTS 1128052 12/1984 U.S.S.R. ..... 122/510

*Primary Examiner*—Edward G. Favors

*Attorney, Agent, or Firm*—Berman, Aisenberg & Platt

[57] ABSTRACT

A pulse combustion unit for a liquid heating apparatus having a liquid vessel arranged to store an amount of liquid to be heated. The combustion unit includes a base plate mounted on the upper portion of an upright support structure, a pulse combustion burner assembly including a pulse combustion chamber secured to one surface of the base plate and a curved tailpipe having an inner end connected to an exhaust port of the combustion chamber and an outer end connected to the base plate, and an air-fuel mixer head secured to the other surface of the base plate and being in open communication with the interior of the combustion chamber through an opening of the base plate. The liquid vessel is coupled at its side wall with the base plate in such manner that the combustion chamber and tailpipe are arranged in the vessel. An air supply part and a fuel supply part for the mixer head are mounted within a lower portion of the support structure, and an exhaust part for the tailpipe is mounted on the support structure at a position located below the combustion chamber.

3 Claims, 4 Drawing Sheets

PULSE COMBUSTION UNIT FOR LIQUID HEATING APPARATUS

BACKGROUND OF THE INVENTION

1. Field of the Invention

The present invention relates to a liquid heating apparatus of the pulse combustion type, and more particularly to a pulse combustion unit for the heating apparatus which can be combined with a liquid vessel of different shape or capacity selectively mounted thereto.

2. Description of the Prior Art

In a conventional liquid heating apparatus of the pulse combustion type, an air-fuel mixer head and a pulse combustion burner assembly are mounted on a liquid vessel which is previously mounted on a support frame, an air supply part and gas supply part for the mixer head are assembled with the support frame, and an exhaust part for the burner assembly is further assembled with the support frame. In such arrangement of the heating apparatus, it is impossible to replace the liquid vessel with another vessel of different shape or capacity in accordance with customers' requirements. To satisfy the customers' requirements, it has been needed to change the support frame and its associated parts in construction in accordance with the shape or capacity of a liquid vessel selectively adapted thereto. This results in an obstacle to prompt supply of the heating apparatus and an increase of the manufacturing cost.

SUMMARY OF THE INVENTION

It is, therefore, a primary object of the present invention to provide a pulse combustion unit for the heating apparatus which can be combined with a liquid vessel of different shape or capacity selectively mounted thereto without any change of a support structure for the mixer head and the pulse cobmustion burner assembly and their associated parts.

According to the present invention, the object is attained by providing a pulse combustion for a liquid heating apparatus having a liquid vessel arranged to store an amount of liquid to be heated, which pulse combustion unit comprises an upright support structure mounted on a floor, a base plate mounted on an upper portion of the support structure, a pulse combustion burner assembly including a pulse combustion chamber secured to one surface of the base plate and a curved tailpipe having an inner end connected to an exhaust port of the combustion chamber and an outer end connected to the base plate, an air-fuel mixer head secured to the other surface of the base and being in open communication with the interior of the combustion chamber through a central opening of the base plate, an air supply part mounted within lower portion of the support structure and including an air intake pipe in communication with the mixer head for supplying fresh air into the mixer head, a fuel supply part mounted within the lower portion of the support structure adjacent the air supply part and including a fuel supply conduit in communication with the mixer head for supplying gaseous fuel into the mixer head, and an exhaust part mounted on the support structure at a position located below the combustion chamber and including an exhaust pipe connected to the outer end of the tailpipe to exhaust combustion products from the tailpipe. In the pulse combustion unit, the liquid vessel is coupled at a side wall thereof with the base plate in such a manner that the combustion chamber and tailpipe are arranged in the vessel.

BRIEF DESCRIPTION OF THE DRAWINGS

Additional objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
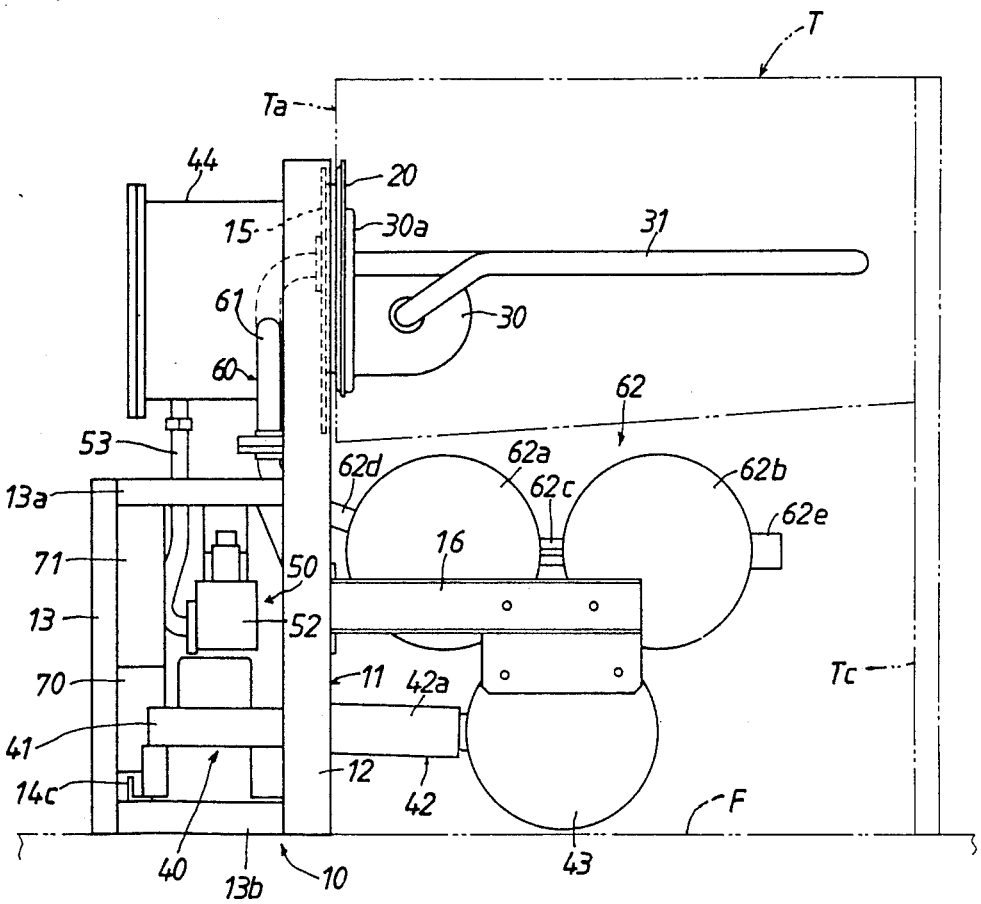
FIG. 1 is a side view of a pulse combustion unit in accordance with the present invention.
Figure 2:
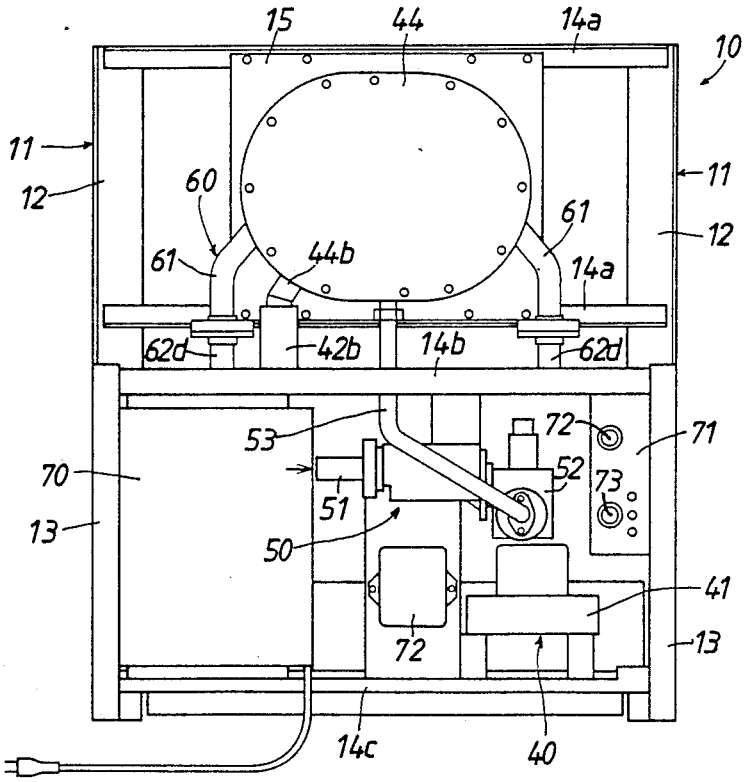
FIG. 2 is a front view of the pulse combustion unit shown in FIG. 1.
Figure 3:
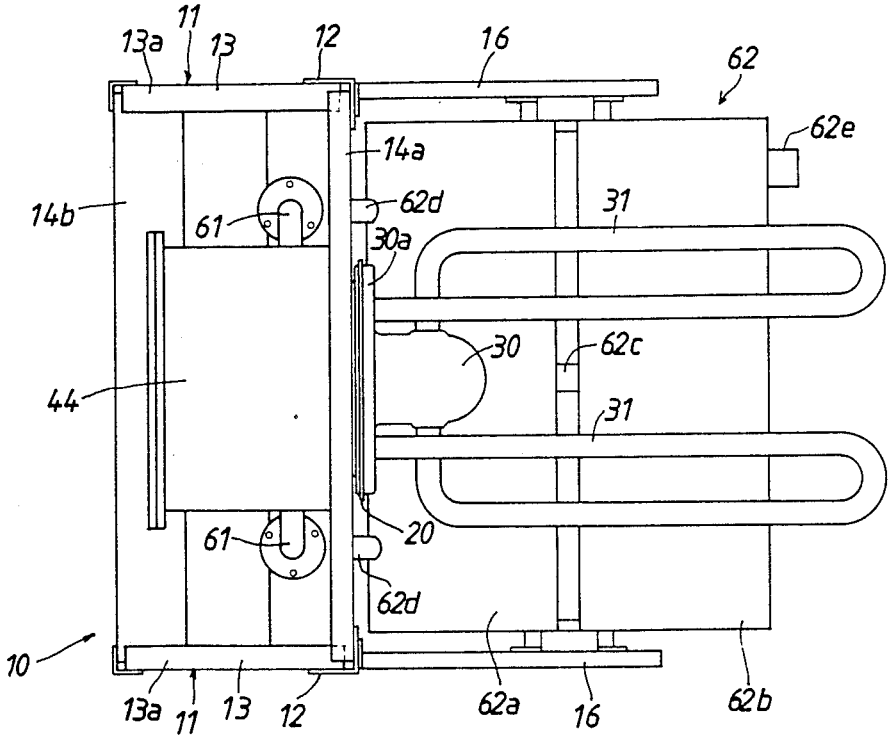
FIG. 3 is a plan view of the pulse combustion unit shown in FIG. 1.

In FIGS. 1 to 3 of the drawings, there is illustrated a pulse combustion unit for a liquid heating appratus mounted on an upright suport structure 10 on a floor F. The support structure 10 is composed of a pair of upright side frames 11 connected to each other by means of parallel angle beams 14*a*, 14*b* and 14*c*. The upright side frames 11 each include an upright main angle member 12 connected to an upright sub-angle member 13 by means of upper and lower members 13*a* and 13*b*. Attached to the two upper angle beams 14*a*, 14*a* are a support base plate 20 and a mounting plate 15 which are secured in place by means of bolts respectively for supporting thereon a pulse combustion burner assembly and an air chamber casing 44. The pulse combustion burner assembly includes a combustion chamber 30, a pair of tailpipes 31 and an air-fuel mixer head 32. At the rear portion of support structure 10, a pair of horizontal stays 16 are secured at their one ends to the lower portions of upright main angle members 12 by welding to support thereon an air intake muffler 43 and an exhaust muffler assembly 62.

Figure 5:
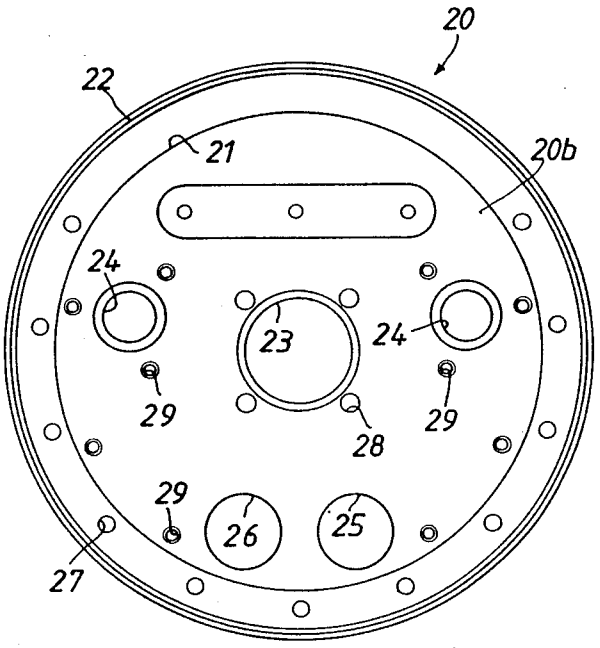
FIG. 5 is a front view of the base plate.
Figure 4:
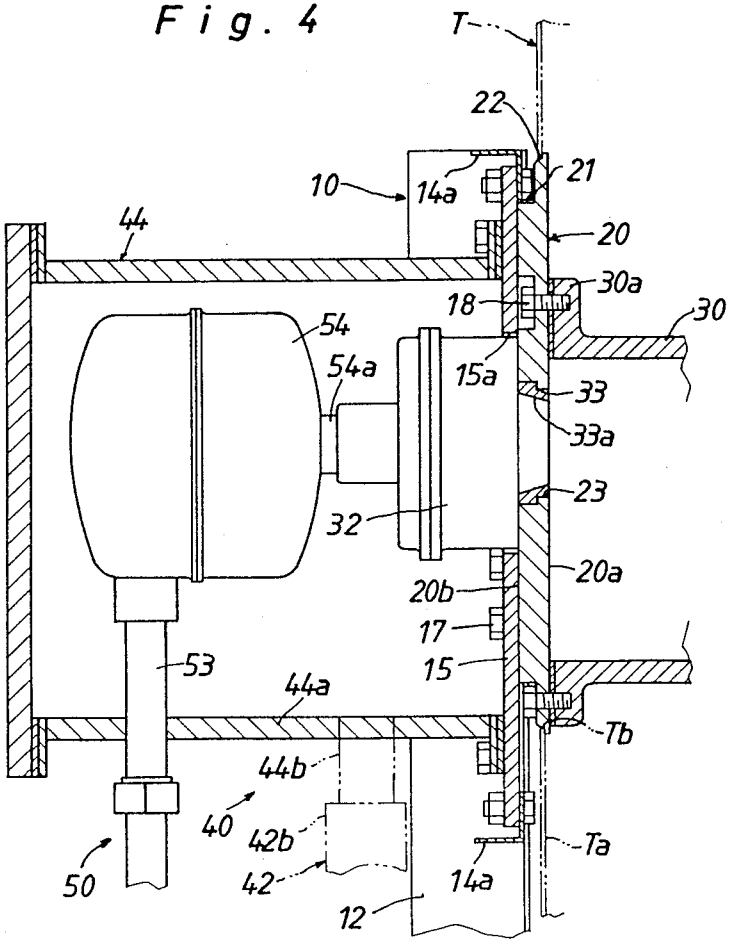
FIG. 4 is an enlarged sectional view of component parts assembled with a support base plate shown in FIG. 1.

As shown in FIGS. 4 and 5, the support base plate 20 is in the form of a circular plate having flat surfaces 20*a*, 20*b* and being formed at its outer periphery with annular stepped portions 21 and 22. The base plate 20 is engaged with the mounting plate 15 at its front flat surface 20*b* and secured in place by means of bolts 17 threaded into screw holes 29 of the base plate 20 through the mounting plate 15. The combustion chamber 30 of the burner is formed at its inlet end with an annular flange 30*a* which is engaged with the rear flat surface 20*a* of base plate 20 and secured in place by means of bolts 18 threaded into mounting holes 27 of the base plate 20 in a liquid-tight manner. The air-fuel mixer head 32 is engaged with the front flat surface 20*b* of base plate 20 and secured in place by means of bolts (not shown) threaded into mounting holes 28 of the base plate 20 in an air-right manner. The base plate 20 has a central opening 23 which receives an annular burner head 33 coupled therein. The burner head 33 has a tapered intake 33*a* through which the interior of mixer head 32 communicates with the interior of combustion chamber 30.

As shown in FIGS. 1 and 3, the tailpipes 31 are connected at their inner ends to a pair of exhaust ports of combustion chamber 30 by welding and extended rearwardly in parallel to one another. The tailpipes 31 are bent forwardly in parallel at their intermediate portions and connected at their outer ends to the annular flange 30*a* of combustion chamber 30 by welding in each position corresponding to a pair of exhaust holes 24 in the base plate 20. As shown in FIG. 5, the base plate 20 is formed at its lower portion with mounting holes 25 and 26 through which a spark plug and a flame rod (not shown) are inserted into the interior of combustion chamber 30. As shown in FIG. 4, the mounting plate 15 is formed with an aperture 15*a* through which the mixer head 32 is mounted to the base plate 20. In addition, the mounting plate 15 is further formed with corresponding holes (not shown) to the exhaust holes 24 and mounting holes 25, 26 in the base plate 20.

As shown in FIGS. 1, 2 and 4, an air supply part 40 for the mixer head 32 includes an electrically operated air blower 41 and air intake muffler 43. The air blower 41 is mounted on the lower angle beam 14*c* at a lower portion of upright support structure 10, and the air intake muffler 43 is carried by the horizontal stays 16 at its opposite ends. The air blower 41 is connected to the air intake muffler 43 by means of a lower section 42*a* of an air intake pipe 42, and air intake muffler 43 is connected to the air chamber casing 44 by means of an upstanding section 42*b* of intake pipe 42. (see FIG. 4) Thus, the fresh air from blower 41 is supplied into the air chamber casing 44 through the intake pipe 42 and muffler 43. As shown in FIG. 4, the air chamber casing 44 is mounted to the mounting plate 15 to enclose the mixer head 32 and is provided at its lower portion with an inlet pipe 44*b* for connection to the upstanding section 42*b* of intake pipe 42. In this arrangement, the mixer head 32 is provided at its one side with an air intake flapper valve (not shown) for permitting only the inward flow of fresh air supplied therein from the air chamber casing 44.

As shown in FIGS. 1 and 4, a gas supply part 50 for the mixer head 32 includes an electromagnetic valve assembly 52 mounted within a lower portion of support structure 10 and a gas container 54 arranged in the air chamber casing 44. The valve assembly 52 connected to the gas container 54 by means of an upstanding gas supply conduit 53. The gas container 54 has a tubular boss 54*a* coupled with the mixer head 32 and being provided therein with a gas intake flapper valve (not shown) for permitting only the flow of gaseous fuel supplied into the mixer head 32 from a source of gaseous fuel (not shown) through the valve assembly 52 and conduit 53. The valve assembly 52 includes an electromagnetic valve with an inlet port 51 for connection to the source of gaseous fuel and gas pressure governor connected in series with the electromagnetic valve.

As shown in FIGS. 1 to 3, an exhaust part 60 for the tailpipes 31 includes a pair of exhaust pipes 61 connected at their upper ends to the outer ends of tailpipes 31 and an exhaust muffler assembly 62 carried by the horizontal stays 16. The exhaust muffler assembly 62 includes a cylindrical decoupler 62*a* and cylindrical exhaust muffler 62*b* which are connected to each other by means of a pipe 62*c*. The decoupler 62*a* is connected to the lower ends of exhaust pipes 61 by means of a pair of connecting pipes 62*d*, while the exhaust muffler 62*b* is provided with an exhaust pipe 62*e*. The exhaust pipes 61 each are provided at their upper ends with an annular flange which is attached to the mounting plate 15 and secured in place by means of bolts threaded into screw holes 29 of a base plate 20 in surrounding relationship with the exhaust hole 24. The exhaust pipes 61 each are extended downwardly through a peripheral wall 44*a* of air chamber casing 44 and connected to the upper ends of connecting pipes 62*e* by means of a flange coupling. Within the front lower portion of support structure 10, an electric control apparatus 70 and a operation panel 71 are arranged for control of the pulse combustion burner, and an ignition device 72 is arranged for energizing the spark plug in the combustion chamber 30. The operation panel 71 is provided thereon with a temperature setting knob 72, a power switch knob 73 and indication lamps for informing the operator of operation of the burner, an abnormal condition and the like.

Under control of the electrical control apparatus, the electromagnetic valve of assembly 52 is opened to effect the supply of gaseous fuel into the gas container 44, while the air blower 41 is operated for a predetermined short period of time to effect the supply of air into the air chamber casing 44. Thus, the mixer head 32 is supplied with the gaseous fuel and air from gas container 54 and casing 44 to supply a mixture of the gaseous fuel and air into the combustion chamber 30 therefrom. The mixture is ignited by energization of the spark plug (not shown) in the combustion chamber 30. When explosive combustion of the mixture takes place in the combustion chamber 30, the flapper valves in the tubular boss 54*a* and mixer head 32 are closed by a momentary positive pressure in the combustion chamber 30 to block the inward flow of gaseous fuel and air into the mixer head 32, and the combustion products are exhausted through the tailpipes 31, exhaust pipes 61, decoupler 62 and muffler 62*b*. Ignition and combustion are followed by a contraction which produces a momentary negative pressure in the tailpipes 31 for drawing in a fresh supply of gaseous fuel and air through the flapper valves in the tubular boss 54*a* and mixer head 32. During the momentary negative pressure, the flow of combustion products at each exhaust end of tailpipes 31 is reversed. The fresh charge which has been drawn in during the momentary negative pressure automatically ignites without the need for energization of the spark plug, and the explosive combustion repeats itself.

With the above arrangement of the pulse combustion unit, a liquid vessel T of different shape and capacity can be selectively adapted to the heating apparatus in a simple manner to satisfy customers' requirements. In application to the pulse combustion unit, as shown in FIG. 4, the liquid vessel T is previously formed at its front wall Ta with a circular opening Tb for engagement with the annular stepped portion 22 of support base plate 20. During assembly process of the liquid vessel T, the base plate 20 is removed from the mounting plate 15, and the combustion chamber 30 and mixer head 32 are removed from the base plate 20. In such a condition, the base plate 20 is coupled with the circular opening Tb of vessel T at its annular stepped portion 22 and secured to the front wall Ta of vessel T by welding in a liquid-tight manner. Thereafter, the combustion chamber 30 and mixer head 32 are mounted to the base plate 20 in such a manner that the tailpipes 31 are horizontally arranged in the vessel T. When the base plate 20 has been secured to the mounting plate 15, the vessel T is supported on the upright support structure 10 at its front wall Ta as shown by imaginary lines in FIG. 1. In addition, the vessel T is horizontally supported on the floor F by means of appropriate stays Tc secured to its rear wall in accordance with the height of support structure 10.

Although in the above embodiment the pulse combustion unit has been mounted as a single unit on the upright support structure 10, plurality of laterally arranged pulse combustion units may be mounted on an upright support structure substantially in the same manner as described above to be combined with a liquid vassel of large capacity. In such a case, the electric control apparatus 70 and operation panel 71 can be adapted to control all the pulse combustion units, and the tailpipes 31 can be replaced with other tailpipes which are arranged in the vessel in an appropriate manner.

What is claimed is:

1. A pulse combustion unit for a liquid heating apparatus having a liquid vessel arranged to store an amount of liquid to be heated, comprising:

an upright support structure mounted on a floor;

a base plate mounted to an upper portion of said support structure;

a pulse combustion burner assembly including a pulse combustion chamber secured to one surface of said base plate and a curved tailpipe having an inner end connected to an exhaust port of said combustion chamber and outer end connected to said base plate;

an air-fuel mixer head secured to the other surface of said base plate and being in open communication with the interior of said combustion chamber through a central opening of said base plate;

an air supply part mounted within a lower portion of said support structure, said air supply part including an air intake pipe in communication with said mixer head for supplying fresh air into said mixer head;

a fuel supply part mounted within the lower portion of said support structure adjacent said air supply part, said fuel supply part including a fuel supply conduit in communication with said mixer head for supplying gaseous fuel into said mixer head; and an exhaust part mounted on said support structure at a position located below said combustion chamber, said exhaust part including an exhaust pipe connected to the outer end of said tailpipe to exhaust combustion products from said tailpipe, wherein said liquid vessel is coupled at a side wall thereof with said base plate in such a manner that said combustion chamber and tailpipe are arranged in said vessel.

2. A pulse combustion unit as claimed in claim 1, wherein said base plate is detachably attached to a mounting plate provided on the upper portion of said upright support structure.

3. A pulse combustion unit as claimed in claim 2, wherein an air chamber casing is mounted to said mounting plate to enclose said mixer head.

* * * * *